US010099487B2

(12) United States Patent
Ito et al.

(10) Patent No.: US 10,099,487 B2
(45) Date of Patent: Oct. 16, 2018

(54) IMAGE RECORDING APPARATUS

(71) Applicant: Brother Kogyo Kabushiki Kaisha, Nagoya-shi, Aichi-ken (JP)

(72) Inventors: Tsuyoshi Ito, Nagoya (JP); Gakuro Kanazawa, Toyokawa (JP); Kenji Samoto, Nagoya (JP); Wataru Sugiyama, Nishio (JP); Yasuhira Ota, Yatomi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/004,035

(22) Filed: Jan. 22, 2016

(65) Prior Publication Data

US 2016/0214409 A1 Jul. 28, 2016

(30) Foreign Application Priority Data

Jan. 23, 2015 (JP) ..... 2015-011845

(51) Int. Cl.
*B41J 2/165* (2006.01)
*B41J 11/00* (2006.01)

(52) U.S. Cl.
CPC ..... *B41J 11/0045* (2013.01)

(58) Field of Classification Search
None
See application file for complete search history.

(56) References Cited

U.S. PATENT DOCUMENTS 6,896,432 B2 5/2005 Ohyama
7,232,269 B2 6/2007 Ohyama
7,341,338 B2 * 3/2008 Uwagaki ..... B41J 13/025 347/104
2003/0048345 A1 3/2003 Matsumoto
2004/0126164 A1 7/2004 Ohyama
2005/0168557 A1 8/2005 Ohyama
2006/0268292 A1 * 11/2006 Takeuchi ..... B41J 23/025 358/1.8
2014/0092186 A1 * 4/2014 Iijima ..... B41J 11/006 347/104
2014/0146118 A1 * 5/2014 Ito ..... B41J 11/006 347/104

FOREIGN PATENT DOCUMENTS

JP H08-208094 A 8/1996
JP 2003-176071 A 6/2003
JP 2004-106978 A 4/2004

* cited by examiner

*Primary Examiner* — Alejandro Valencia
(74) *Attorney, Agent, or Firm* — Banner & Witcoff, Ltd.

(57) ABSTRACT

An image recording apparatus includes a recording unit configured to record an image on a sheet conveyed in a conveyance direction; a first wavy shape applying mechanism provided downstream in the conveyance direction from the recording unit and configured to allow the sheet to be in a wavy state in a width direction; and a guide member configured to guide the sheet to the first wavy shape applying mechanism. The first wavy shape applying mechanism includes first spur rollers configured to abut against a first surface of the sheet respectively; abutment members provided between the mutually adjoining first spur rollers respectively and configured to abut against a second surface of the sheet; and second spur rollers configured to abut against the first surface of the sheet downstream of the first spur rollers in the conveyance direction.

10 Claims, 10 Drawing Sheets

IMAGE RECORDING APPARATUS

CROSS REFERENCE TO RELATED APPLICATION

The present application claims priority from Japanese Patent Application No. 2015-011845 filed on Jan. 23, 2015 the disclosure of which is incorporated herein by reference in its entirety.

BACKGROUND

Field of the Invention

The present invention relates to an image recording apparatus which makes it possible to provide a wavy state of a sheet on which an image is to be recorded by a recording unit.

Description of the Related Art

Conventionally, in the case of an ink-jet recording apparatus which records an image by discharging ink droplets from nozzles provided for a recording unit onto a sheet such as recording paper or the like supported by a platen, a phenomenon (cockling) occurs in some cases, in which a part of the sheet adhered with inks swells to rise or float up from the platen. When the cockling occurs, then the part of the sheet, which floats up from the platen, is brought in contact with, for example, the recording unit and/or a guide member for guiding the sheet, and it is feared to cause, for example, any disturbance or disorder of the image recorded on the sheet and/or any paper jam or clog-up.

On this account, a structure is known, which makes it possible to suppress the occurrence of the cockling by providing a plurality of paper discharge rollers, a plurality of first spur rollers, and a plurality of second spur rollers which are provided downstream from a platen in the conveyance direction. Specifically, the plurality of paper discharge rollers are arranged while providing spacing distances respectively in the width direction orthogonal to the conveyance direction. The plurality of paper discharge rollers are brought in contact with a surface of the sheet opposite to a surface on which an image is recorded. The first spur rollers are provided opposingly over or above the plurality of paper discharge rollers respectively. The sheet is conveyed while being nipped or interposed by the mutually opposing first spur rollers and the paper discharge rollers. The plurality of second spur rollers are arranged respectively between the first spur rollers which mutually adjoin in the width direction.

The plurality of second spur rollers respectively abut against the surface on which the image is recorded, with respect to the sheet conveyed from the platen. The abutment portions are pushed and moved downwardly from the uppermost ends of the paper discharge rollers. Accordingly, the sheet is in the wavy state in the width direction. When the sheet is in the state as described above, even if the inks adhere to the sheet supported on the platen and any part of the sheet swells, then it is possible to suppress the occurrence of the phenomenon (cockling) in which the sheet floats up from the platen.

SUMMARY

However, usually, the sheet, which is conveyed from the recording unit, is guided to the second spur rollers by an inclined surface provided for a guide member. When the sheet, which is guided by the inclined surface of the guide member, is in the wavy state in the width direction by means of the second spur rollers, it is feared that the end portion in the width direction of the sheet may leap up to abut against the inclined surface which guides the sheet. In this situation, a large load is applied to the end portion in the width direction of the sheet by the inclined surface. Therefore, there is such a possibility that the sheet is not conveyed in the predetermined direction to cause, for example, the paper jam or clog-up and the damage of sheet.

The present teaching has been made taking the foregoing circumstances into consideration, an object of which is to provide an image recording apparatus which makes it possible to suppress the occurrence of the paper jam or clog-up and the damage of the sheet when the sheet is allowed to be in a wavy state in the width direction.

According to a first aspect of the present teaching, there is provided an image recording apparatus including: a recording unit configured to record an image on a sheet conveyed in a conveyance direction; a first wavy shape applying mechanism provided downstream of the recording unit in the conveyance direction and configured to allow the sheet to be in a wavy state in a width direction orthogonal to the conveyance direction; and a guide member configured to guide the sheet to the first wavy shape applying mechanism, wherein the first wavy shape applying mechanism includes: first spur rollers provided within a first range in the width direction to be apart from each other in the width direction and configured to abut against a first surface of the sheet respectively, all of the first spur rollers being provided within the first range; abutment members provided between the mutually adjoining first spur rollers respectively and configured to abut against a second surface of the sheet; and second spur rollers provided within second ranges, which are disposed on both outer sides in the width direction of the first range, respectively and configured to abut against the first surface of the sheet downstream of the first spur rollers in the conveyance direction, the guide member includes: a first guide surface provided at a position upstream of the first spur rollers in the conveyance direction and corresponding to the first range, and being inclined so that a distance from the abutment members, which is provided in an orthogonal direction orthogonal to the conveyance direction and the width direction, is shortened from upstream to downstream in the conveyance direction; and second guide surfaces each provided at a position downstream of the first guide surface and upstream of the second spur rollers in the conveyance direction and corresponding to one of the second ranges, and each being inclined so that a distance from the abutment member in the orthogonal direction is shortened from upstream to downstream in the conveyance direction, and a first distance between the first guide surface and the abutment members in the orthogonal direction is shorter than a second distance between each of the second guide surfaces and the abutment members in the orthogonal direction, in a range in which the first guide surface is provided in the conveyance direction.

In this arrangement, the sheet is guided by the first guide surface of the guide member to the first spur rollers of the first wavy shape applying mechanism, and the sheet is allowed to be in the wavy state in the width direction by means of the first spur rollers. In this case, the first guide surface is not provided in the second range. Therefore, even when the end portion in the width direction of the sheet is in the leaping up state, there is no fear of abutment of the end portion against the first guide surface. After that, the end portion is guided by the second guide surface to the second spur roller. In this way, when the sheet is allowed to be in the wavy state in the width direction, there is no fear of application of any large load to the end portion in the width direction of the sheet. Therefore, it is possible to suppress the occurrence of, for example, the paper clog-up or jam and the damage of the sheet.

According to a second aspect of the present teaching, there is provided an image recording apparatus including: a recording unit configured to record an image on a sheet conveyed in a conveyance direction; a wavy shape applying mechanism configured to allow the sheet conveyed in the conveyance direction to be in a wavy state in a width direction orthogonal to the conveyance direction; and a guide member configured to guide the sheet to the wavy shape applying mechanism, wherein the wavy shape applying mechanism includes: first abutment members provided within a range in the width direction to be apart from each other in the width direction and configured to abut against a first surface of the sheet respectively, all of the first abutment members being provided within the range; second abutment members configured to abut against a second surface of the sheet between the mutually adjoining first abutment members respectively, and third abutment members provided at positions corresponding to both outer sides of the range in the width direction respectively and configured to abut against the first surface of the sheet downstream of the first abutment members in the conveyance direction, the guide member includes: a first guide surface provided at a position upstream of a position at which the first abutment members abut against the sheet in the conveyance direction and corresponding to the range, and being inclined so that a distance from the second abutment members, which is provided in an orthogonal direction orthogonal to the conveyance direction and the width direction, is shortened from upstream to downstream in the conveyance direction; and a second guide surface provided upstream of the second abutment members in the conveyance direction and being inclined so that a distance from the second abutment members in the orthogonal direction is shortened from upstream to downstream in the conveyance direction.

In this arrangement, the sheet is guided by the first guide surface of the guide member to the first abutment member of the wavy shape applying mechanism, and the sheet is allowed to be in the wavy state in the width direction by means of the first abutment member. In this case, even when the end portion in the width direction of the sheet is in the leaping up state, there is no fear of abutment of the end portion against the first guide surface. After that, the end portion is guided by the second guide surface to the third abutment member. In this way, when the sheet is allowed to be in the wavy state in the width direction, there is no fear of application of any large load to the end portion in the width direction of the sheet. It is possible to suppress the occurrence of, for example, the paper clog-up or jam and the damage of the sheet.

DESCRIPTION OF THE EMBODIMENTS

An explanation will be made below about an embodiment of the present teaching appropriately with reference to the drawings. Note that it goes without saying that the embodiment explained below is merely an example of the present teaching, and the embodiment of the present teaching can be appropriately changed within a range without changing the gist or essential characteristics of the present teaching. In the following explanation, the upward-downward direction 7, the front-back direction 8, and the width direction (right-left direction) 9 are defined on the basis of the state of FIG. 1 in which a multifunction peripheral 10 is installed usably.

<Overall Structure of Multifunction Peripheral 10>

Figure 1:
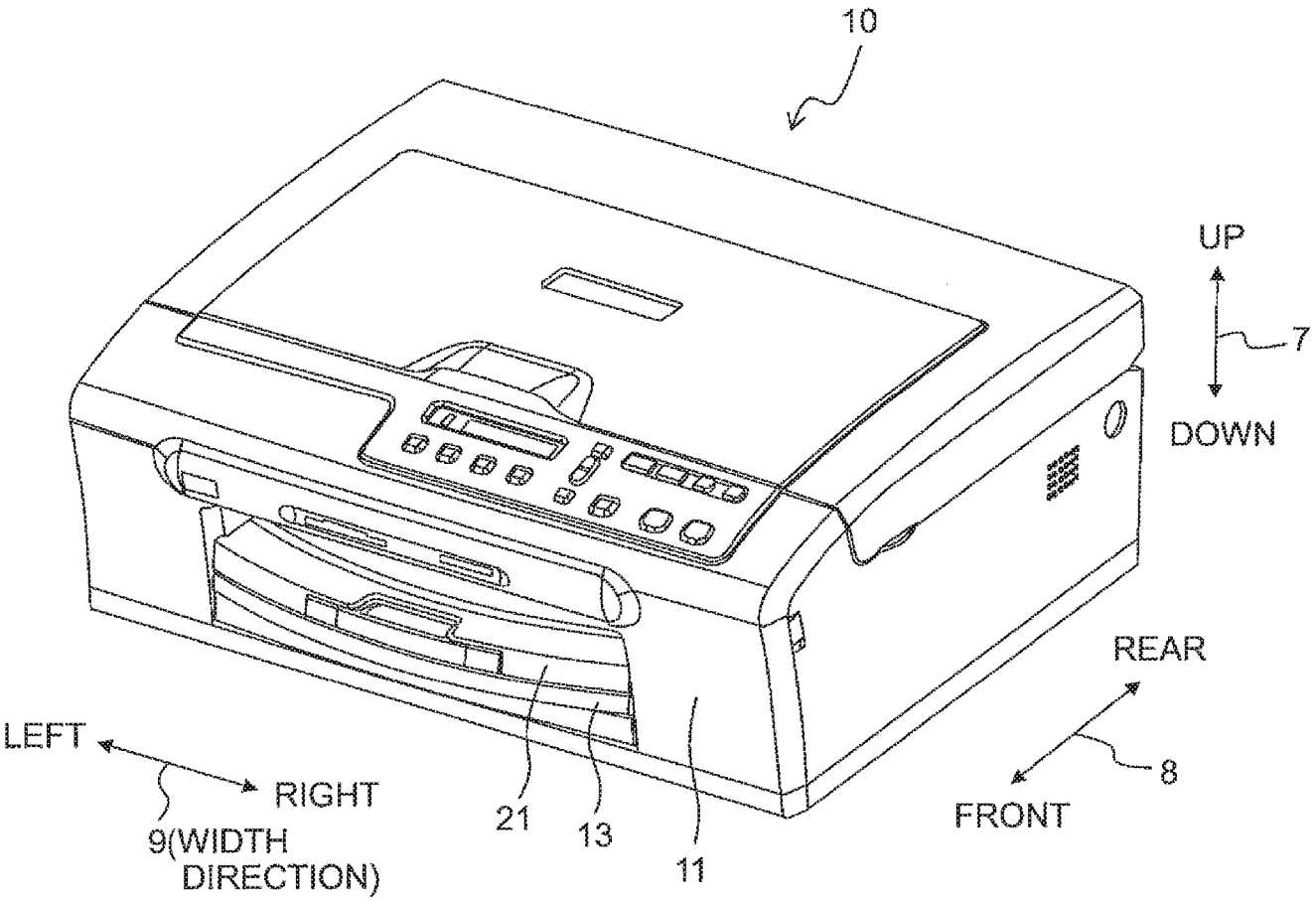
FIG. 1 is a perspective view illustrating a multifunction peripheral as an example of an embodiment of the present teaching.

The multifunction peripheral 10 (example of the image recording apparatus of the present teaching) depicted in FIG. 1 has various functions including, for example, the printer function, the facsimile function, and the copy function. The multifunction peripheral 10 has a main apparatus body 11 which is constructed to have a generally thin type rectangular parallelepiped shape, and a feed tray 13 which is detachable with respect to a lower portion of the main apparatus body 11. As depicted in FIG. 1, the feed tray 13 is in the non-installed state with respect to the main apparatus body 11 by being drawn frontwardly from the main apparatus body 11 in the state in which the feed tray 13 is installed to the main apparatus body 11.

Figure 2:
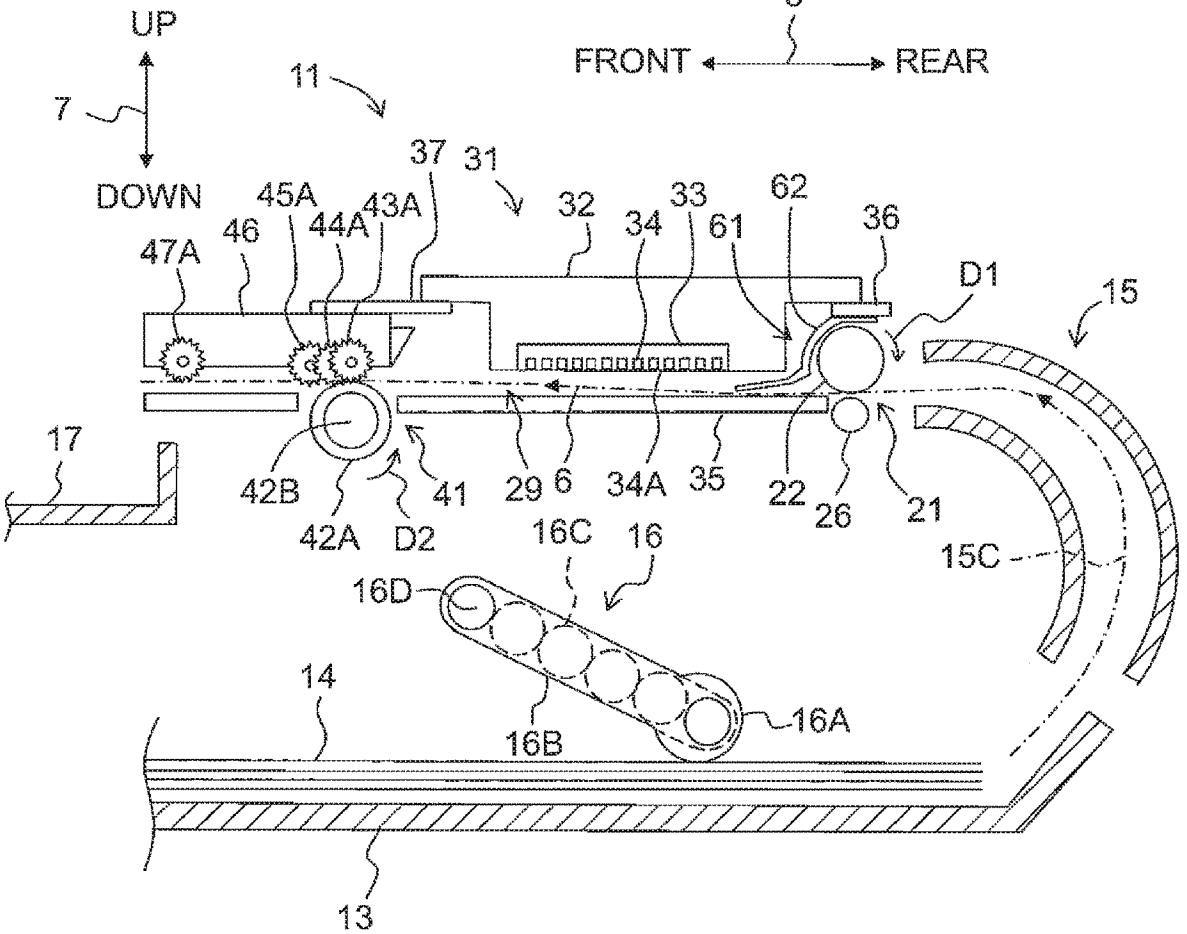
FIG. 2 is a schematic view illustrating a structure of the multifunction peripheral.

As depicted in FIG. 2, a recording unit 31, which records an image on a recording medium, is provided at an upper portion in the main apparatus body 11. The feed tray 13, which is installed to the main apparatus body 11, is positioned under or below the recording unit 31. A plurality of sheets (of the recording medium), on which the image is to be formed by the recording unit 31, can be accommodated therein while being piled up in the upward-downward direction. In this embodiment, the recording paper 14, which is the regular paper (plain paper) of the A4 size, is accommodated in the feed tray 13 as the sheets in a state in which the longitudinal direction extends in the front-back direction 8.

Those provided at the inside of the main apparatus body 11 are a feed unit 16 which backwardly conveys one sheet of the recording paper 14 disposed at the uppermost position accommodated in the feed tray 13, and a feed guide member 15 which upwardly guides the recording paper 14 conveyed backwardly from the feed tray 13. The feed guide member 15 is arranged at the position disposed closely to the back surface in the main apparatus body 11.

The feed unit 16 has a feed roller 16A which is arranged in the width direction 9, and a support arm 16B which movably supports the feed roller 16 in the upward-downward direction. The support arm 16B is rotatably supported by a support shaft 16D in the width direction 9. The feed roller 16A is rotatably supported at the forward end portion of the support arm 16B. The feed roller 16A is moved to the position at which the feed roller 16A abuts against the recording paper 14 disposed at the uppermost position accommodated in the feed tray 13 and the position at which the feed roller 16A is separated upwardly from the recording paper 14, in accordance with the rotation of the support arm 16B in the upward-downward direction 7 about the center of the support shaft 16D. The feed roller 16A is rotated by the motive power of an unillustrated motor transmitted by a motive power transmission mechanism 16C. When the feed roller 16A is rotated in a state in which the feed roller 16A abuts against the recording paper 14 disposed at the uppermost portion accommodated in the feed tray 13, the recording paper 14 is fed backwardly. The recording paper 14, which is fed from the feed tray 13, is conveyed to the lower end portion of the feed guide member 15.

The feed guide member 15 is provided with a feed passage 15C through which the recording paper 14 passes. The feed passage 15C has a circular arc-shaped form protruding toward the back surface of the main apparatus body 11. The recording paper 14, which is guided by the feed guide member 15, is conveyed frontwardly from the upper end portion of the feed guide member 15.

Note that the recording paper 14 accommodated in the feed tray 13 is conveyed in a state in which the central portion in the width direction 9 passes along the central portion in the width direction 9 of the feed passage 15C (on the basis of the center). Further, the multifunction peripheral 10 can feed, on the basis of the center, not only the recording paper 14 having the A4 size but also the recording paper having a size smaller than the above, for example, the postal card (having the rigidity higher than that of the regular paper) to the feed passage 15C.

A conveyance roller pair (example of the second conveyance roller pair) 21, which conveys the recording paper 14 allowed to pass through the upper end portion of the feed guide member 15 to the position disposed under the recording unit 31, is provided at the front position disposed closely to the upper end portion of the feed guide member 15. A platen 35, which supports the recording paper 14 under the recording unit 31, is provided in front of the conveyance roller pair 21, i.e., in the conveyance direction of the recording paper 14 conveyed by the conveyance roller pair 21 (hereinafter referred to as "sheet conveyance direction 6" (see FIG. 2)). An upstream wavy shape applying mechanism (example of the second wavy shape applying mechanism) 61 and a downstream wavy shape applying mechanism (example of the first wavy shape applying mechanism) 41, each of which applies the wavy shape in the width direction 9 to the recording paper 14, are provided on the upstream and the downstream in the sheet conveyance direction 6 with respect to the platen 35.

The recording paper 14, which has passed through the feed guide member IS, is conveyed by the conveyance roller pair 21 to a conveyance passage 29 formed between the platen 35 and the recording unit 31. The conveyance passage 29 extends to a paper discharge tray 17 via the downstream wavy shape applying mechanism 41.

The conveyance roller pair 21 has one first conveyance roller (example of the first roller) 22 which abuts against the upper surface (first surface) of the recording paper 14 having passed through the feed guide member 15, and a plurality of pinch rollers (example of the second roller) 26 which abut against the lower surface (second surface) of the recording paper 14. The recording paper 14, which has passed through the feed guide member 15, is conveyed onto the platen 35 by being nipped or interposed by the first conveyance roller 22 and the pinch rollers 26 which are in the rotation state.

The recording unit 31, which is provided over or above the platen 35, is supported by a first guide frame 36 and a second guide frame 37 each of which is arranged in the width direction 9. The first guide frame 36 and the second guide frame 37 extend in the width direction 9 in a state in which a constant spacing distance is provided in the sheet conveyance direction 6. The recording unit 31 has a carriage 32 which is supported slidably while extending between the first guide frame 36 and the second guide frame 37, and a recording head 33 which is attached to a lower portion of the carriage 32. The carriage 32 is reciprocatably movable in the width direction 9 along the first guide frame 36 and the second guide frame 37.

The recording head 33 is provided with a plurality of nozzles 34 which discharge inks downwardly. The inks are supplied to the respective nozzles 34 from ink cartridges (not depicted). The plurality of nozzles 34 are arranged in an array form along with the sheet conveyance direction 6. The lower ends of the respective nozzles 34 are open on a nozzle surface 34A as the lower surface of the recording head 33. The nozzle surface 34A is a flat surface extending in the front-back direction 8 and the width direction 9. The platen 35, which is provided under or below the recording unit 31, supports the recording paper 14 conveyed by the conveyance roller pair 21 in a state of being parallel to the nozzle surface 34A.

As for the recording unit 31, when the recording paper 14, which is conveyed by the conveyance roller pair 21, arrives at a predetermined position on the platen 35, the conveyance of the recording paper 14 is stopped. In the state as described above, the carriage 32 is allowed to slide in the width direction 9 orthogonal to the sheet conveyance direction 6, and the recording process, in which the inks are selectively discharged from the nozzles 34 of the recording head 33, is executed during the sliding movement. After that, the conveyance process in which the recording paper 14 on the platen 35 is conveyed by a predetermined distance by means of the conveyance roller pair 21 and the recording process which is performed by the recording head 33 are repeatedly executed. Thus, an image is recorded on the entire recording paper 14.

The downstream wavy shape applying mechanism 41, which is provided in the sheet conveyance direction 6 for the platen 35, conveys, in the sheet conveyance direction 6, the recording paper 14 supported on the platen 35. Further, the downstream wavy shape applying mechanism 41 applies the wavy shape in the width direction 9 to the recording paper 14 on the platen 35. The recording paper 14, which has passed through the downstream wavy shape applying mechanism 41, is discharged onto the paper discharge tray 17.

<Conveyance Roller Pair>

Figure 3:
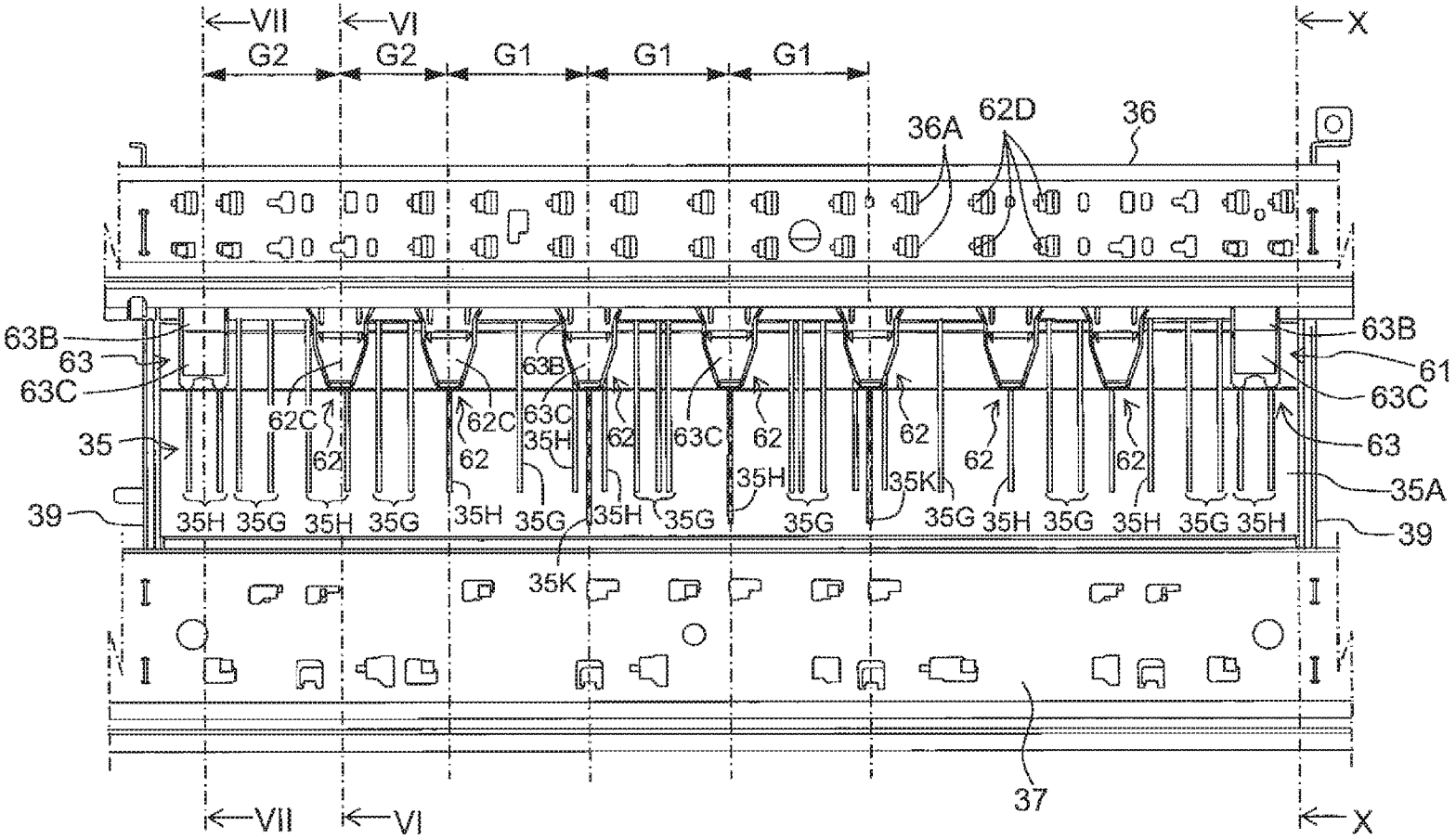
FIG. 3 is a plan view illustrating a first guide rail and a second guide rail.

The conveyance roller pair 21 constitutes the upstream wavy shape applying mechanism 61. The first conveyance roller 22 of the conveyance roller pair 21 is supported by subframes 39 (see FIG. 3) which support the both end portions of the first guide frame 36 in the width direction 9 respectively. Note that as depicted in FIG. 3, the second guide frame 37 has the both end portions in the width direction 9 which are supported by the subframes 39 respectively as well. The rotation of the unillustrated motor is transmitted to the first conveyance roller 22 which is rotated in the direction depicted by the arrow D1 in FIG. 2.

The plurality of pinch rollers 26 are provided under the first conveyance roller 22, and the plurality of pinch rollers 26 are supported by roller holders (not depicted) in a state in which spacing distances are provided in the width direction 9 respectively. The roller holder is movable so that each of the pinch rollers 26 is in a separated state as starting from a state in which each of the pinch rollers 26 is brought in contact with the first conveyance roller 22. The respective pinch rollers 26, which are brought in contact with the first conveyance roller 22, are rotated while following the rotation of the first conveyance roller 22.

<Upstream Wavy Shape Applying Mechanism>

As depicted in FIG. 3, the upstream wavy shape applying mechanism 61 has seven upstream abutment members (example of the second abutment member) 62 which are attached to the lower surface of the first guide frame 36, and two end abutment members 63 which are provided at the both end portions in the width direction 9 respectively. Further, main ribs 35G, which are provided for the platen 35 as described later on, also constitute the upstream wavy shape applying mechanism 61.

Three of the seven upstream abutment members 62, which are positioned at the central portion in the width direction 9, constitute a central wavy shape applying unit 61A, and two of the seven upstream abutment members 62, which are provided on the both sides in the width direction 9 with respect to the central wavy shape applying unit 61A respectively, constitute one set of side wavy shape applying units 61B. The central upstream abutment member 62, which is included in the central wavy shape applying unit 61A, is provided at the position corresponding to the center of the platen 35 in the width direction 9. The three upstream abutment members 62, which constitute the central wavy shape applying unit 61A, are arranged while providing constant spacing distances G1. The three upstream abutment members 62 are provided in order that the wavy shape is not applied to the recording paper of the small size (for example, postal card) which has a length in the width direction 9 such that only the three upstream abutment members 62 are allowed to abut thereagainst, but the wavy shape is applied to the recording paper 14 of the A4 size. When the postal card is conveyed, the three upstream abutment members 62 abut against the postal card, and the entire platen 35 is moved downwardly. Accordingly, the wavy shape is not applied to the postal card.

As depicted in FIG. 3, the two upstream abutment members 62, which constitute the side wavy shape applying units 61B, are arranged while providing a spacing distance G2 shorter than the spacing distance G1 described above. Spacing distances, each of which is equal to the spacing distance G1, are provided between the upstream abutment members 62 which are disposed at the both ends in the width direction 9 of the central wavy shape applying unit 61A and the upstream abutment members 62 which are disposed closely to the central wavy shape applying unit 61A and which are included in the side wavy shape applying units 61B.

Figure 6:
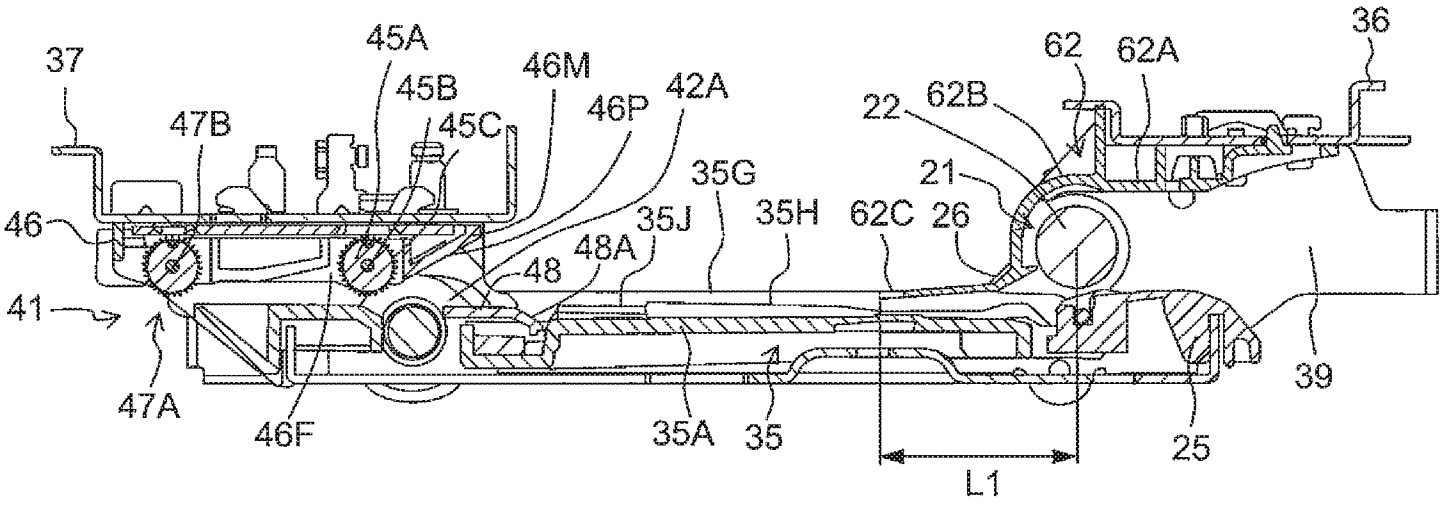
FIG. 6 is a sectional view taken along a line VI-VI in FIG. 3.

The seven upstream abutment members 62 have the same shape respectively. As depicted in FIG. 6, the upstream abutment member 62 has a base portion 62A which is attached to the lower surface of the first guide rail 36, a connecting portion 62B which is in a state of hanging vertically from the base portion 62A, and an abutment portion 62C which is provided at the lower end portion of the connecting portion 62B. The upstream abutment member 62 is integrally molded with synthetic resin (for example, polyacetal (POM)).

The base portion 62A is arranged along the lower surface of the first guide rail 36, and the base portion 62A has a plurality of fastening portions 62D which are to be fastened to the first guide rail 36. The respective fastening portions 62D protrude upwardly from the base portion 62A. The first guide rail 36 is provided with openings 36A into which the respective fastening portions 62D are to be inserted.

The connecting portion 62B has a band plate-shaped form in which the length in the width direction 9 is approximately constant. The connecting portion 62B is formed to have a curved shape which protrudes frontwardly so as to extend along the outer circumferential portion of the first conveyance roller 22 from the front end portion of the base portion 62A. The front end portion of the connecting portion 62B is positioned in front of the base portion 62A and under or below the base portion 62A. The connecting portion 62B has the flexibility to be capable of moving in the upward-downward direction 7 and the front-back direction 8.

The abutment portion 62C, which is provided at the lower end portion of the connecting portion 62B, has a flat plate shape. The abutment portion 62C is formed to have such a triangular shape that the length in the width direction 9 is successively shortened in the direction directed toward the front side as viewed in a plan view. The abutment portion 62C is positioned on the upstream in the conveyance direction of the recording paper 14 as compared with the positions of the nozzles 34 of the recording unit 31. The abutment portion 62C is inclined so that the forward end portion, which is positioned on the downstream in the conveyance direction, is positioned at the lowermost position. The forward end portion of the abutment portion 62C is lower than the upper end portion of the main rib 35G provided for the platen 35. As depicted in FIG. 6, the position, at which the abutment portion 62C of the upstream abutment member 62 abuts against the upper surface of the recording paper 14, is separated by the distance L1 on the downstream in the sheet conveyance direction 6 from the nipping position NP1 of the recording paper 14 nipped by the conveyance roller pair 21.

Figure 7:
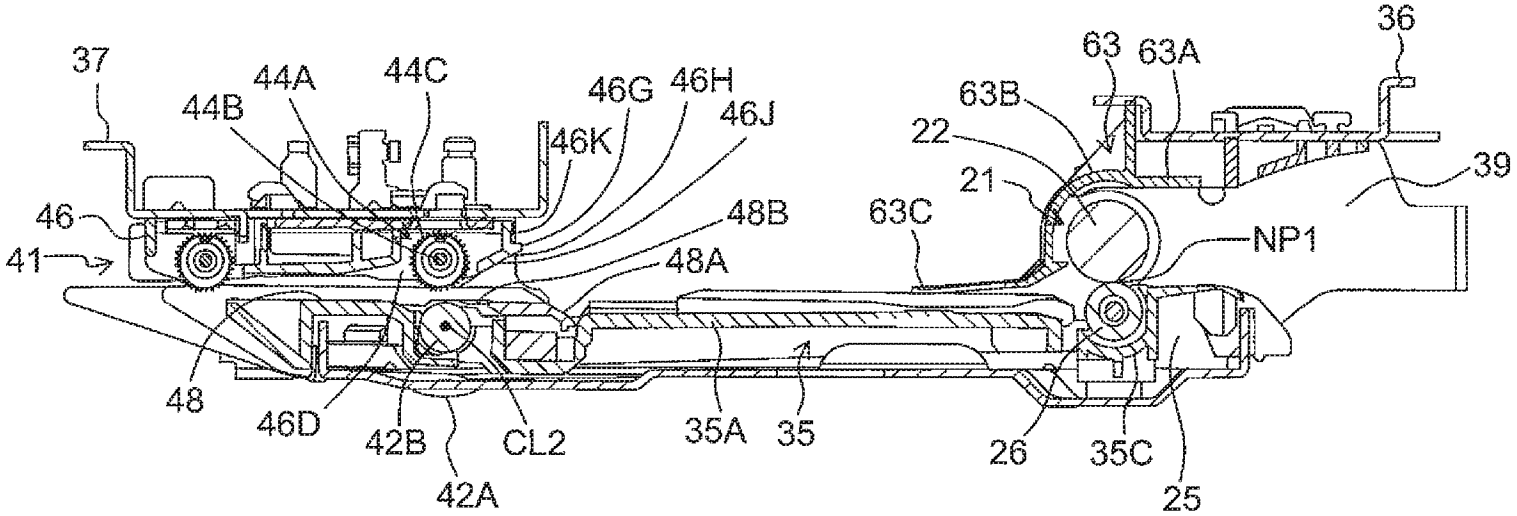
FIG. 7 is a sectional view taken along a line VII-VII in FIG. 3.

As depicted in FIG. 7, each of the end abutment members 63 provided on the both outer sides in the width direction 9 of all of the upstream abutment members 62 has a base portion 63A, a connecting portion 63B, and an abutment portion 63C, in the same manner as the upstream abutment member 62. The abutment portion 63C has a quadrangular shape as viewed in a plan view. The other constitutive features of the end abutment member 63 are generally the same as or equivalent to the constitutive features of the upstream abutment member 62. The abutment portions 63C of the end abutment members 63 downwardly press the both end portions in the width direction 9 of the recording paper 14 conveyed by the conveyance roller pair 21.

<Platen>

As depicted in FIGS. 6 and 7, the platen 35 has a main platen body 35A which is continuous from the position disposed under the upstream abutment member 62 to the position disposed upstream in the sheet conveyance direction 6 as compared with the nipping positions of the recording paper 14 to be nipped or interposed by second conveyance rollers 42A and the third spur rollers 43A. The main platen body 35A is constructed to have a band plate-shaped form in the width direction 9 orthogonal to the sheet conveyance direction 6. The main platen body 35A is supported rotatably about the center of the roller shaft 42B, by the roller shaft 42B of the second conveyance roller 42A.

The flat plate-shaped main platen body 35A is provided with three main ribs 35B between the mutually adjoining upstream abutment members 62 of the central wavy shape applying unit 61A. Each of the main ribs 35G protrudes upwardly from the upper surface of the main platen body 35A in a state of extending in the front-back direction 8. Further, one main rib 35G, which is constructed in the same manner as described above, is also provided between each of the upstream abutment members 62 disposed at the both ends in the width direction 9 of the central wavy shape applying unit 61A and the upstream abutment member 62 of the side wavy shape applying unit 61B disposed closely to the central wavy shape applying unit 61A.

Further, two main ribs 35G, which are constructed in the same manner as described above, are also provided between the pair of upstream abutment members 62 of the side wavy shape applying unit 61B while providing a spacing distance in the width direction 9. Further, two main ribs 35G, which are constructed in the same manner as described above, are also provided between the end abutment member 63 and the upstream abutment member 62 of the side wavy shape applying unit 61B disposed closely to the end abutment member 63 while providing a spacing distance in the width direction 9.

Each of the main ribs 35G protrudes while providing a constant height from the upper surface of the main platen body 35A. The upper surface of each of them is flat, and the height is approximately the same. Each of the main ribs 35G extends from the end portion on the upstream in the sheet conveyance direction 6 of the main platen body 35A to the position deviated to the downstream as compared with the intermediate position in the sheet conveyance direction 6.

Further, the main platen body 35A is provided with one sub-rib 35H at the position corresponding to the lower portion of the central upstream abutment member 62 of the central wavy shape applying unit 61A. The sub-rib 35H protrudes upwardly from the upper surface of the main platen body 35A in a state of extending in the front-back direction 8. The upper surface of the sub-rib 35H is low under the central upstream abutment member 62. However, the upper surface of the sub-rib 35H is inclined so that the height is gradually increased in the direction directed to the downstream on the downstream in the sheet conveyance direction 6 from the upstream abutment member 62. Further, a constant protruding height is provided such that the protruding height is low as compared with the main rib 35G at portions disposed on the downstream in the sheet conveyance direction 6, the portions being continuous to the inclined portion. The downstream position in the sheet conveyance direction 6 of the sub-rib 35H is approximately the same position as the downstream position in the sheet conveyance direction 6 of the main rib 35G.

Further, the main platen body 35A is provided with a pair of sub-ribs 35H which are constructed in the same manner as described above and which are provided under each of the upstream abutment members 62 disposed at the both ends in the width direction 9 of the central wavy shape applying units 61A while providing a spacing distance in the width direction 9. One auxiliary rib 35K is provided between the pair of sub-ribs 35H at the downstream position in the sheet conveyance direction 6 with respect to the sub-rib 35H. The auxiliary rib 35K is constructed in approximately the same manner as described above except that the auxiliary rib 35K is deviated to the downstream in the sheet conveyance direction 6 as compared with the sub-ribs 35H disposed on the both sides.

The main platen body 35A is also provided with one sub-rib 35H which is constructed in the same manner as described above and which is disposed at the position disposed under each of the upstream abutment members 62 for constructing the side wavy shape applying units 61B respectively. Further, the main platen body 35A is also provided with one sub-rib 35H which is constructed in the same manner as described above at the positions on the both outer sides in the width direction 9 of the side wavy shape applying units 61B.

The upper surface of the abutment portion 62C of the upstream abutment member 62 is flat, and the upper surface is lower than the main rib 35G provided for the main platen body 35A as described above. Therefore, when the abutment portion 62C abuts against the upper surface (first surface) of the recording paper 14, the recording paper 14 is in a state of being depressed in a recessed form between the main ribs 35G positioned on the both outer sides in the width direction 9 of the abutment portion 62C.

One sub-rib 35H or the plurality of sub-ribs 35H is/are positioned between the mutually adjoining main ribs 35G. When the recording paper 14 is allowed to be in the depressed state in the recessed form by the abutment portion 62C, the sub-rib 35H supports the lower surface of each of the portions depressed in the recessed form. The pair of auxiliary ribs 35K guide, to the downstream wavy shape applying mechanism 41, the end portions disposed on the both sides in the width direction 9 of the recording paper of the small size to which the wavy shape is not applied by the central wavy shape applying unit 61A.

<Downstream Wavy Shape Applying Mechanism>

As depicted in FIGS. 6 and 7, the downstream wavy shape applying mechanism 41 has a plurality of second conveyance rollers (example of the abutment member and the second abutment member) 42A which are arranged in the width direction 9, a first guide member 46 which is arranged over or above the second conveyance roller 42A, and a plurality of first spur rollers (example of the first abutment member) 44A, a plurality of second spur rollers (example of the third abutment member) 45A, and a plurality of third spur rollers 43A which are supported by the first guide member 46 respectively.

The plurality of second conveyance rollers 42A abut against the lower surface of the recording paper 14 on which the image has been recorded by the recording unit 31. One roller shaft 42B is inserted through the axial center portion of each of the second conveyance rollers 42A. The third spur rollers 43A, the first spur rollers 44A, and the second spur rollers 45A abut against the upper surface of the recording paper 14 respectively. The plurality of third spur rollers 43A are arranged respectively over the second conveyance rollers 42A while being opposed thereto respectively.

A second guide member 48, which guides the recording paper 14 conveyed from the main platen body 35A to the position over the second conveyance rollers 42A, is provided on the downstream in the sheet conveyance direction 6 from the main platen body 35A. A roller shaft 42B, which penetrates through the axial center portion of the second conveyance roller 42A, is inserted at the lower portion of the second guide member 48. The second guide member 48 is provided with a plurality of openings 48B (see FIG. 7) while providing spacing distances in the width direction 9 over the roller shaft 42B. The openings 48B are provided at the positions corresponding to the downstream in the sheet conveyance direction 6 between the mutually adjoining upstream abutment members 62, the positions corresponding to the downstream in the sheet conveyance direction 6 respectively between the respective end abutment members 63 and the upstream abutment members 62 mutually adjoining to the respective end abutment members 63, and the positions corresponding to the downstream in the sheet conveyance direction 6 of the upstream abutment members 62 and the end abutment members 63 respectively. The second conveyance rollers 42A are arranged respectively in the openings 42B provided at the positions corresponding to the spaces between the mutually adjoining upstream abutment members 62 and the positions corresponding respectively to the spaces between the respective end abutment members 63 and the upstream abutment members 62 mutually adjoining to the respective end abutment members 63.

As depicted in FIGS. 6 and 7, the second guide member 48 is provided with a lower guide surface 48A which guides the recording paper 14 from the main platen body 35A onto the second conveyance roller 42A. The lower guide surface 48A is inclined so that the distance to the axial center CL1 of the third spur roller 43A (see FIG. 8), which is provided in the direction orthogonal to the sheet conveyance direction 6 and the width direction 9, is shortened toward the downstream in the sheet conveyance direction 6.

Each of the second conveyance rollers 42A is constructed to have a cylindrical shape by using an elastic member such as rubber or the like, and each of the second conveyance rollers 42A is fitted to the roller shaft 42B described above in a coaxial state. Each of the eight second conveyance rollers 42A protrudes upwardly from the upper surface of the second guide member 48. The rotational force of the motor is transmitted to the roller shaft 42B by the aid of an unillustrated transmission mechanism, and the roller shaft 42B is rotated in the direction indicated by the arrow D depicted in FIG. 2. Accordingly, all of the second conveyance rollers 42A are integrally rotated.

Figure 8:
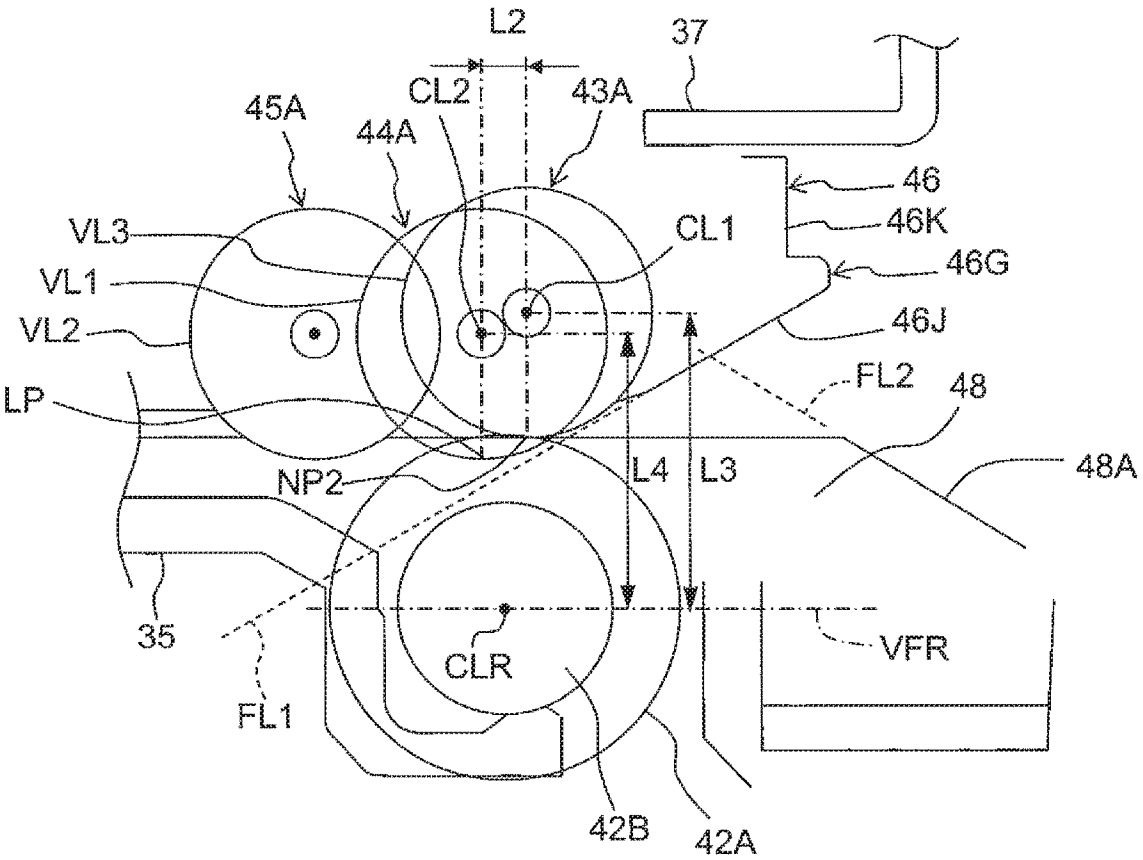
FIG. 8 is a schematic view illustrating a structure of a downstream wavy shape applying mechanism.

The first guide member 46, which supports the third spur rollers 43A, the first spur rollers 44A, and the second spur rollers 45A respectively, is arranged over or above the conveyance passage 29. The length in the width direction 9 of the first guide member 46 is longer than the length in the sheet conveyance direction 6. As depicted in FIG. 8, the third spur roller 43A, which is arranged opposingly over the second conveyance roller 42A, is supported by the end on the upstream in the sheet conveyance direction 6 of the first guide member 46.

Figure 4:
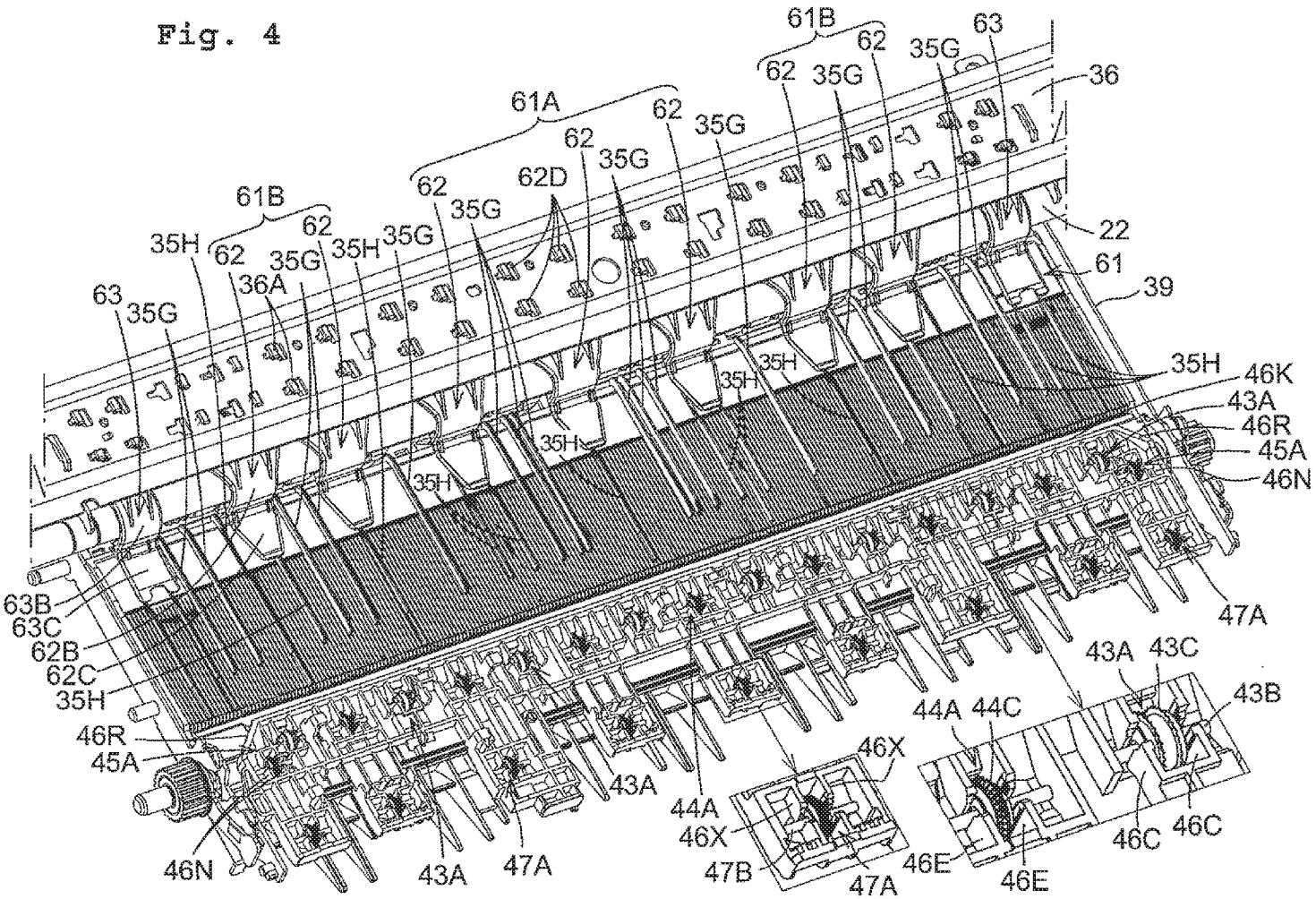
FIG. 4 is a perspective view illustrating a state in which the second guide rail is removed from FIG. 3.

As depicted in FIG. 4 in an enlarged manner, two disk-shaped spur portions 43C are provided for the third spur roller 43A while providing a spacing distance in the width direction 9. Protruding/recessed portions are provided in the circumferential direction on the respective outer circumferential surfaces of the spur portions 43C. A roller shaft 43B, which extends in the width direction 9, is inserted through the axial center portion of the third spur roller 43A. The first guide member 46 is provided with roller support portions 46C which are arranged in the front-back direction 8 and which are disposed on the both sides in the width direction 9 of the third spur roller 43A. The both end portions in the width direction 9 of the roller shaft 43B are rotatably supported by the respective roller support portions 46C respectively.

FIG. 8 depicts a schematic view illustrating the structure of the downstream wavy shape applying mechanism 41. Note that in FIG. 8, the third spur roller 43A, the first spur roller 44A, and the second spur roller 45A are depicted by a third virtual outer circumferential line VL3, a first virtual outer circumferential line VL1, and a second virtual outer circumferential line VL2 which are circular along the outer circumferences respectively.

The third virtual outer circumferential line VL3 of the third spur roller 43A comes in contact with the outer circumferential surface of the second conveyance roller 42A disposed thereunder. When the second conveyance roller 42A is rotated, the third spur roller 43A is rotated while following the rotation thereof. The position of contact between the third virtual outer circumferential line VL3 of the third spur roller 43A and the second conveyance roller 42A is the nipping position NP2 at which the recording paper 14 is nipped or interposed. The recording paper 14, which is conveyed from the platen 35, is nipped at the nipping position NP2, and the recording paper 14 is conveyed to the downstream in the sheet conveyance direction 6.

Figure 5:
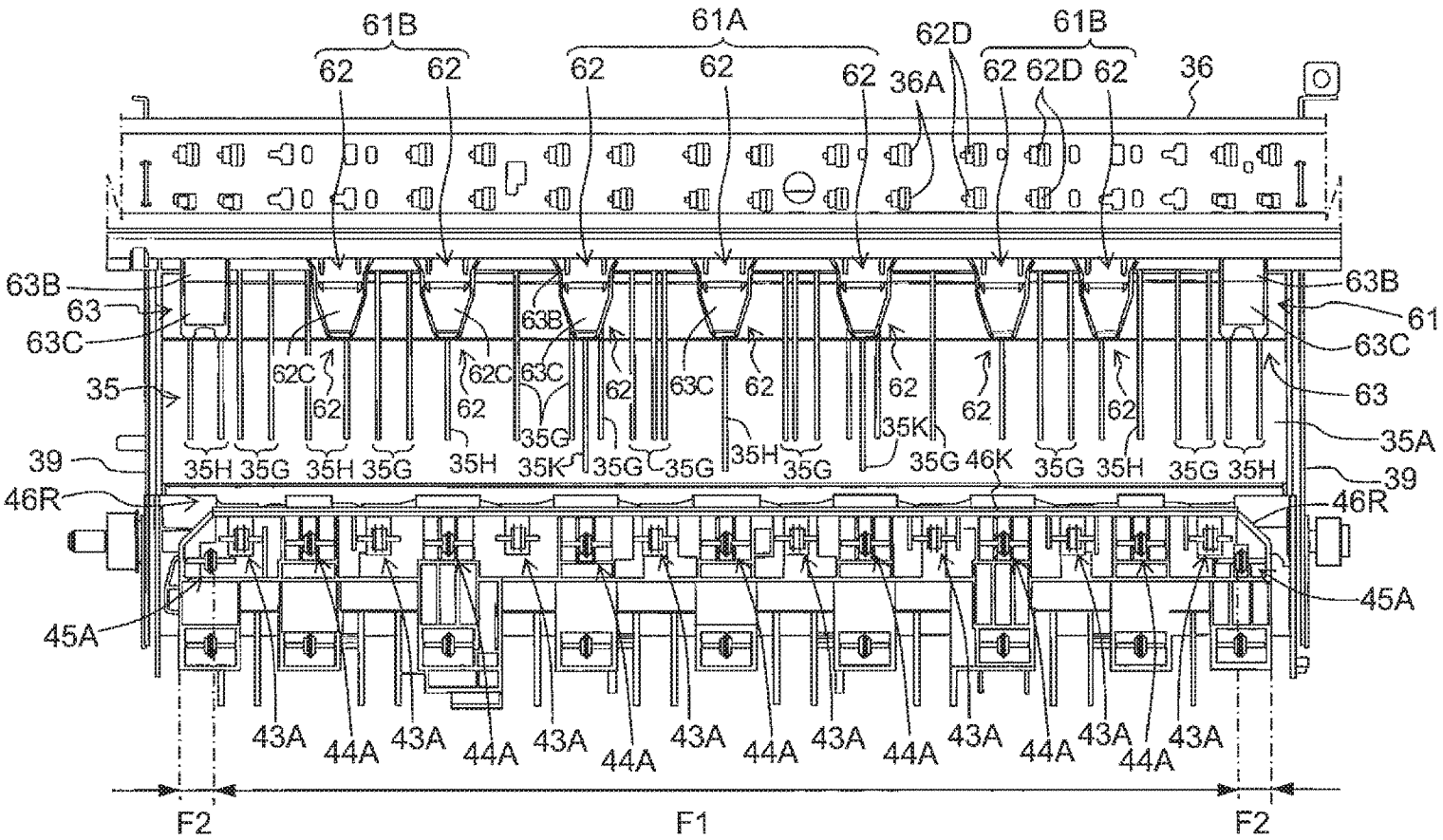
FIG. 5 is a plan view illustrating a state in which the second guide rail is removed from FIG. 3.

As depicted in FIG. 5, the first spur rollers 44A are supported by the first guide member 46 at the positions corresponding to the spaces between the mutually adjoining second conveyance rollers 42A respectively. As for the respective first spur rollers 44A, the positions in the width direction 9 correspond to (coincide with) those of the seven upstream abutment members 62 of the upstream wavy shape applying mechanism 61 described above respectively. The respective first spur rollers 44A are positioned on the downstream in the sheet conveyance direction as compared with the respective upstream abutment members 62.

As depicted in FIG. 4 in an enlarged manner, each of the first spur rollers 44A has one spur portion 44C having the same or equivalent shape as that of each of the spur portions 43C of the third spur rollers 43A. A roller shaft 44B, which is disposed in the width direction, is inserted through the axial center portion of each of them. The both end portions in the width direction 9 of the roller shaft 44B are rotatably supported by second roller support portions 46E provided in the front-back direction 8 for the first guide member 46.

As depicted in FIG. 8, the first spur roller 44A is overlapped with the nipping position NP2 as viewed from a side of the main apparatus body 11 in the width direction 9. In other words, the nipping position NP2 is positioned in the circular first virtual outer circumferential line VL1 provided along with the outer circumference of the first spur roller 44A. The central axis CL2 of the first spur roller 44A is positioned at the position lower than the central axis CL1 of the third spur roller 43A. That is, the distance (distance in the upward-downward direction 7) L4 between the central axis CL2 of the first spur roller 44A in the direction (upward-downward direction 7) orthogonal to the sheet conveyance direction 6 and the width direction 9 respectively and the virtual plane VFR provided in the sheet conveyance direction 6 including the central axis CLR of the second conveyance roller 42A is shorter than the distance L3 between the central axis CL1 of the third spur roller 43A and the virtual plane VFR.

In this case, as for the circular first virtual outer circumferential line VL1 provided along with the outer circumference of the first spur roller 44A, the position LP, at which the distance from the virtual plane VFR including the axial center CLR of the second conveyance roller 42A is the shortest, is separated by the distance (example of the fourth distance) L2 on the downstream in the conveyance direction as compared with the nipping position NP2. The abutment is caused in a state in which the pressure is the largest with respect to the recording paper 14 at the shortest position LP. Therefore, the first spur roller 44A abuts against the recording paper 14 at the position separated by the distance L2 on the downstream in the conveyance direction from the nipping position NP2. The distance L2 is shorter than the distance (example of the third distance) L1 from the nipping position NP1 of the recording paper 14 provided by the conveyance roller pair 21 to the position at which the abutment portion 62C of the upstream abutment member 62 abuts against the upper surface of the recording paper 14. The position, at which the abutment portion 62C of the upstream abutment member 62 abuts against the upper surface of the recording paper 14, corresponds to the position at which the distance from the virtual plane VFR in the conveyance direction including the axial center CLR of the second conveyance roller 42A is the shortest.

As depicted in FIGS. 4 and 5, the second spur rollers 45A are supported respectively at the both end portions in the width direction 9 of the first guide member 46. Each of the second spur rollers 45A is arranged at the position which corresponds to the downstream in the sheet conveyance direction 6 of each of the two end abutment members 63 of the upstream wavy shape applying mechanism 61, the position corresponding to the downstream in the sheet conveyance direction 6 from the first spur roller 44A.

The second spur roller 45A has the same or equivalent structure as that of the first spur roller 44A. As depicted in FIG. 4, a roller shaft 45B is rotatably supported by a third roller support portion 46N provided in the front-back direction 8 for the first guide member 46. As depicted in FIG. 8, as for the second spur roller 45A and the first spur roller 44A, the shortest distance from the virtual plane VFR including the axial center CLR of the second conveyance roller 42A is approximately the same, and the position in the upward-downward direction 7, at which the second spur roller 45A and the first spur roller 44A abut against the recording paper 14, is approximately the same.

As depicted in FIG. 4, the fourth spur rollers 47A are supported respectively by the first guide member 46 at the positions corresponding to the downstream in the sheet conveyance direction 6 of all of the first spur rollers 44A respectively and the positions corresponding to the downstream in the sheet conveyance direction 6 of the second spur rollers 45A respectively. The fourth spur roller 47A has the same or equivalent structure as that of the first spur roller 44A, and a roller shaft 47B is rotatably supported by a fourth roller support portion 46X provided in the front-back direction 8 for the first guide member 46. As depicted in FIGS. 6 and 7, as for the fourth spur roller 47A and the first spur roller 44A, the shortest distance from the virtual plane VFR including the axial center CLR of the second conveyance roller 42A is approximately the same, and the position in the upward-downward direction, at which the fourth spur roller 47A and the first spur roller 44A abut against the recording paper 14, is approximately the same.

As depicted in FIGS. 4 to 7, a wall surface 46K, which is provided vertically upstandingly in the width direction 9, is provided at the upstream end portion in the sheet conveyance direction 6 of the first guide member 46. The wall surface 46K is positioned in the vicinity of the main platen body 35A on the downstream in the sheet conveyance direction 6 with respect to the main platen body 35A of the platen 35. As depicted in FIG. 5, the wall surface 46K is arranged over the first range F1 provided in the width direction 9 including all of the third spur rollers 43A supported by the first guide member 46.

As depicted in FIG. 7, a first guide portion 46G, which extends toward the downstream and the downward in the sheet conveyance direction 6, is provided at the lower end portion of the wall surface 46K. The first guide portion 46G is arranged over the entire region in the width direction 9 of the wall surface 46K, i.e., over the first range F1 described above.

As depicted in FIG. 8, the first guide portion 46G is inclined so that the distance from the axial center of the second conveyance roller 42A, which is provided in the direction orthogonal to the conveyance direction 6 and the width direction 9, is shortened toward the downstream from the upstream in the conveyance direction 6. The first guide portion 46G is provided with a plurality of guide ribs 46H which protrude from the first guide portion 46G and which are disposed while providing spacing distances in the width direction 9. Each of the guide ribs 46H is provided in the direction of inclination of the first guide portion 46G. The forward end surface on the protruding side of each of each of the guide ribs 46H forms a first guide surface 46J which is inclined so that the distance from the axial center of the second conveyance roller 42A, which is provided in the direction orthogonal to the conveyance direction 6 and the width direction 9, is shortened toward the downstream from the upstream in the conveyance direction 6, in the same manner as the first guide portion 46G.

Figure 9:
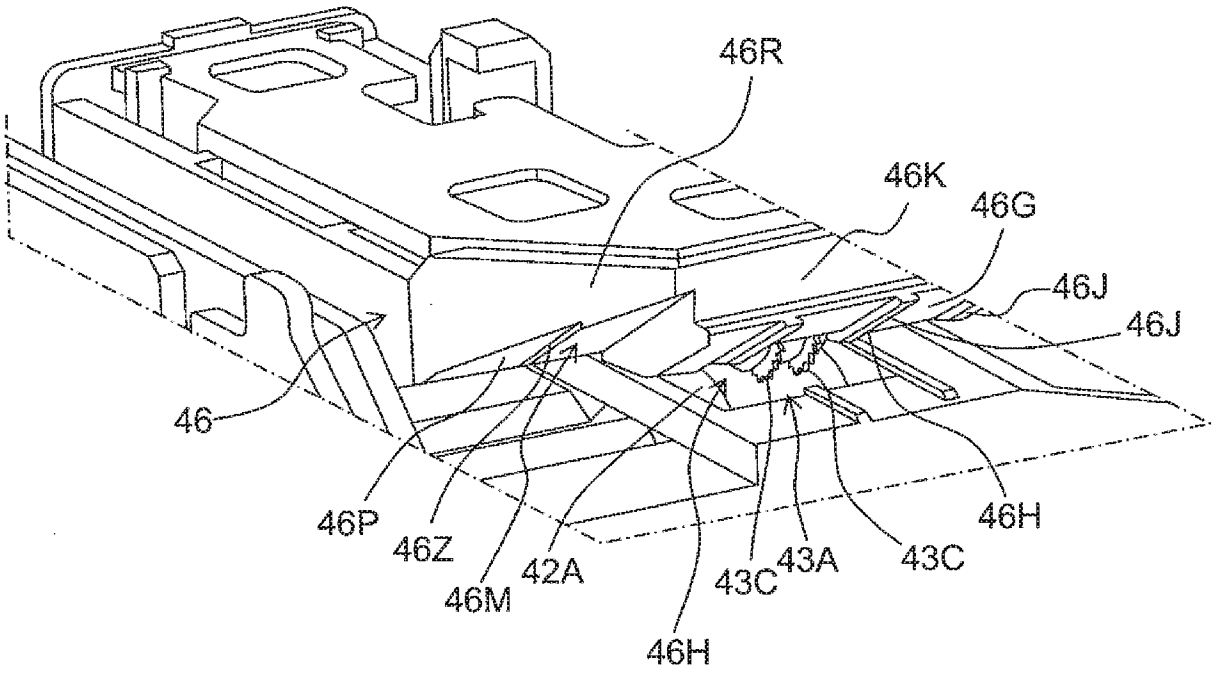
FIG. 9 is a perspective view illustrating a part of a first guide member.

As depicted in FIG. 9, a third guide surface 46R, which extends in the sheet conveyance direction 6 on each of the both outer sides of the wall surface 46K, is provided at each of the end portions on the both sides in the width direction 9 of the wall surface 46K of the first guide member 46. The third guide surface 46R is arranged while being inclined with respect to the sheet conveyance direction 6 and the width direction 9 in the second range F2 disposed on each of the both outer sides in the width direction 9 with respect to the first range F1 described above. The third guide surface 46R is inclined so that the most downstream position in the conveyance direction 6 is positioned on the outermost side in the width direction 9 as compared with the most upstream position.

Figure 10:
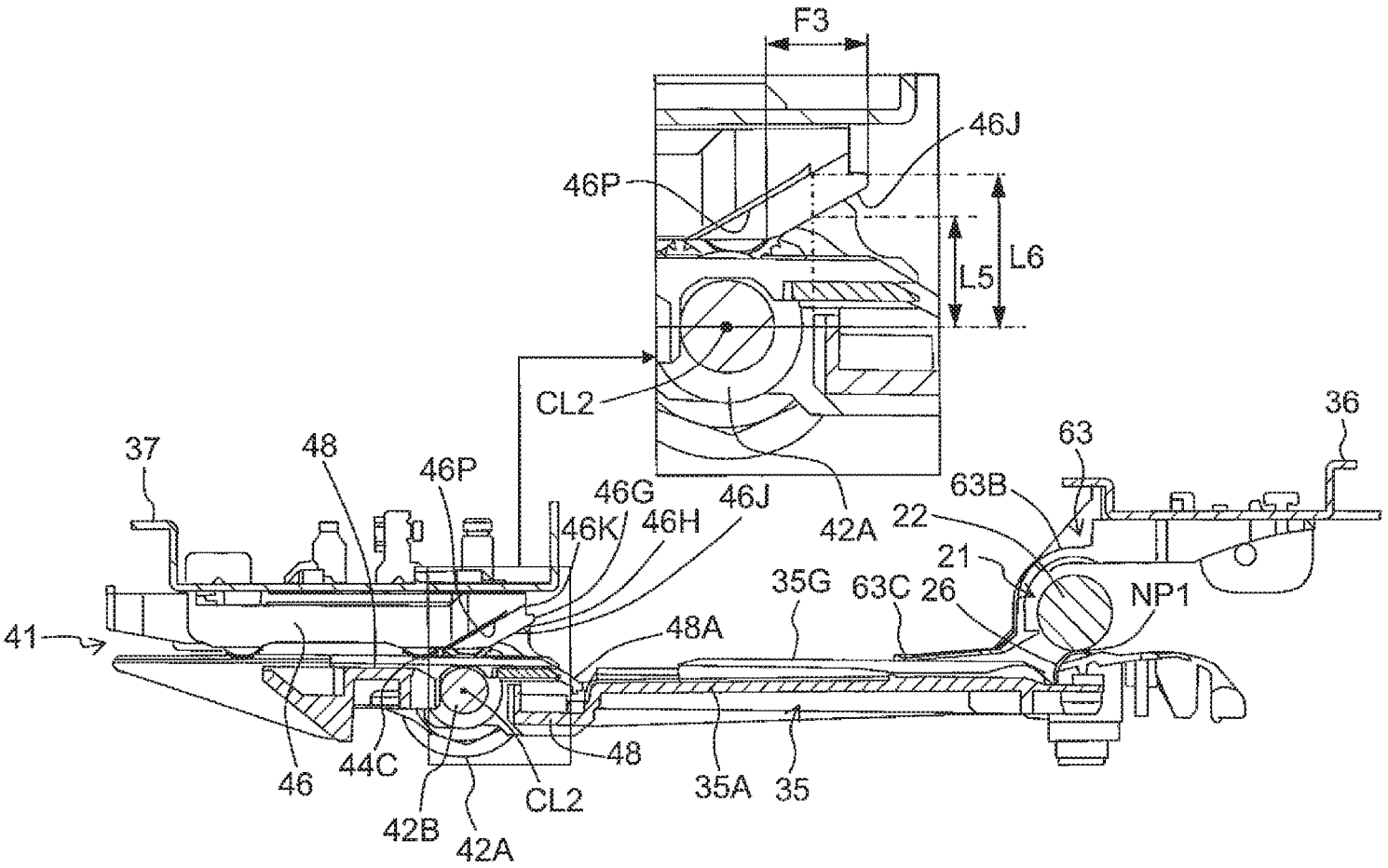
FIG. 10 is a sectional view taken along a line X-X in FIG. 3.

As depicted in FIGS. 9 and 10, a second guide portion 46M, which extends toward the downstream and the downward in the sheet conveyance direction 6, is continuously provided at the lower end of the third guide surface 46R. The second guide portion 46M is arranged in the second range F2 in the same manner as the third guide surface 46R. The second guide portion 46M has a second guide surface 46P which is inclined so that the second guide surface 46P approaches the virtual plane VFR including the axial center CLR of the second conveyance roller 42A toward the downstream from the upstream in the sheet conveyance direction 6. The second guide surface 46P is inclined so that the distance from the axial center of the second conveyance roller 42A, which is provided in the direction orthogonal to the conveyance direction 6 and the width direction 9, is shortened toward the downstream from the upstream in the conveyance direction 6, in the same manner as the first guide surface 46J.

In this case, as depicted in FIG. 10, the fifth distance L5 (example of the first distance) between the first guide surface 46J and the axial center of the second conveyance roller 42A, which is provided in the direction orthogonal to the conveyance direction 6 and the width direction 9, is shorter than the sixth distance (example of the second distance) L6 between the second guide surface and the axial center of the second conveyance roller 42A which is provided in the direction orthogonal to the conveyance direction 6 and the width direction 9, in the range F3 in which the first guide surface 46J is provided in the conveyance direction 6. Further, the most downstream position of the second guide surface 46P, which is provided in the conveyance direction 6, is positioned between the third spur roller 43A and the first spur roller 44A in the conveyance direction 6.

The second guide surface 46P is in an inclined state in the same manner as the first guide surface 46J. However, a difference in height 46Z, which is provided along with the direction of inclination of the second guide surface 46P, is formed at a central portion in the width direction 9. The difference in height 46Z is formed such that the portions positioned on the outer sides in the width direction 9 on each of the second guide surfaces 46P are positioned on the downstream in the sheet conveyance direction 6 as compared with the portion positioned on the central side in the width direction 9 as compared with the difference in height 46Z. The second guide surface 46P is positioned on the downstream in the sheet conveyance direction 6 as compared with the first guide surface 46J. The second guide surface 46P is arranged from the upstream position to the downstream position in the sheet conveyance direction 6 with respect to the nipping position NP2 for the second conveyance roller 42A and the third spur roller 43A.

As depicted in FIG. 8, the first spur roller 44A is arranged so that the first virtual outer circumferential line VL1 is not overlapped with the virtual straight line FL1 extending along the first guide surface 46J as viewed from a side of the main apparatus body 11 in the width direction 9. That is, the first spur roller 44A is positioned on the downstream in the sheet conveyance direction 6 as compared with the virtual straight line FL1 extending along the first guide surface 46J as viewed from a side of the main apparatus body 11 in the width direction 9.

Further, the third spur roller 43A is arranged so that the third virtual outer circumferential line VL3 is not overlapped with the virtual straight line FL1 extending along the first guide surface 46J as viewed from a side of the main apparatus body 11 in the width direction 9. That is, the third spur roller 43A is also positioned on the downstream in the sheet conveyance direction 6 as compared with the virtual straight line FL1 extending along the first guide surface 46J as viewed from a side of the main apparatus body 11 in the width direction 9.

<Function of Upstream Wavy Shape Applying Mechanism, Platen, and Downstream Wavy Shape Applying Mechanism>

In the multifunction peripheral 10 constructed as described above, when the recording paper 14 included in the feed tray 13 is conveyed on the basis of the center from the feed passage 15C in the feed guide member 15 to the conveyance roller pair 21, then the recording paper 14 is nipped or interposed by the first conveyance roller 22 and the pinch roller 26, and the recording paper 14 is conveyed onto the platen 35. In this situation, the forward end portions of the abutment portions 62C of the seven upstream abutment members 62 abut against the upper surface of the recording paper 14 conveyed by the first conveyance roller pair 21 at the positions separated by the distance L1 from the nipping position NP1 of the recording paper 14 nipped by the conveyance roller pair 21. Accordingly, the recording paper 14 is pushed and moved downwardly by the respective abutment portions 62C. Further, the both end portions in the width direction 9 of the recording paper 14 are pushed and moved downwardly by the end abutment members 63 respectively.

The main platen body 35A of the platen 35 is provided with the main ribs 35G on the both outer sides in the width direction 9 of each of the abutment portions 62C. Therefore, the portions, which abut against the main ribs 35G, are not pushed and moved downwardly, and the portions, against which the abutment portions 62C abut, are depressed in the recessed form between the main ribs 35G. Accordingly, the wavy shape formed in the width direction 9 is applied to the recording paper 14. In this case, the lower surfaces of the portions of the recording paper 14 depressed in the recessed form are supported by the sub-ribs 35H.

The image is recorded at the predetermined position under the recording unit 31 on the recording paper 14 to which the wavy shape in the width direction 9 has been applied on the platen 35. After that, the recording paper 14 is conveyed to the downstream wavy shape applying mechanism 41.

In the downstream wavy shape applying mechanism 41, the forward end portion on the downstream side in the sheet conveyance direction 6 of the recording paper 14 conveyed from the position on the platen 35 is conveyed along the lower guide surface 48A provided for the second guide member 48. Subsequently, the forward end portion on the downstream side in the sheet conveyance direction 6 of the recording paper 14 except for the both end portions in the width direction 9 is guided along the first guide surface 46J of the first guide member 46. The recording paper 14 abuts against the outer circumferential surface of the third spur roller 43A in the rotation state, and the recording paper 14 is conveyed toward the nipping position NP2 brought about by the third spur rollers 43A and the second conveyance rollers 42A.

In this situation, each of the first spur rollers 44A is overlapped with the nipping position NP2 as viewed from a viewpoint in the width direction 9. The circular first virtual outer circumferential line VL1, which is provided along the outer circumference of the first spur roller 44A, is overlapped with the virtual straight line FL1 extending along the first guide surface 46J as viewed from a viewpoint in the width direction 9. Accordingly, the recording paper 14, which is guided along the first guide surface 46J of the first guide member 46, abuts against the first spur roller 44A before being nipped at the nipping position NP2. The recording paper 14 is allowed to be in the state of being depressed in the recessed form by the first spur rollers 44A. As a result, the recording paper 14 is in the wavy state in the width direction 9.

As for the recording paper 14 guided by the first guide surface 46J, the rush-in angle (contact angle) with respect to the first spur roller 44A is regulated. Therefore, when the recording paper 14 abuts against the first spur roller 44A, there is no fear of application of any large load on the recording paper 14. Accordingly, the occurrence of, for example, the damage of the recording paper 14 and the clog-up or jam of the paper at the first spur roller 44A are suppressed. Further, the recording paper 14 on the main platen body 35A can be effectively in the wavy state by means of the first spur rollers 44A. Therefore, even when the recording paper 14 swells due to the adhesion of the inks, the occurrence of the cockling is suppressed.

Further, the distance L2, which is provided in the conveyance direction from the nipping position NP2 of the recording paper 14 in the downstream wavy shape applying mechanism 41 to the position of the abutment of the first spur rollers 44A against the recording paper 14, is shorter than the distance L1 which is provided from the nipping position NP1 of the recording paper 14 nipped by the conveyance roller pair 21 in the upstream wavy shape applying mechanism 61 to the position of the abutment of the upstream abutment members 62 against the upper surface of the recording paper 14.

In this case, the second spur rollers 45A abut against the recording paper 14 before providing the state in which the upstream abutment members 62 do not abut against the recording paper 14. As a result, the wavy shape of the recording paper 14 can be stably maintained.

The third virtual outer circumferential line VL3 of the third spur roller 43A is not overlapped with the virtual straight line FL1 extending along the first guide surface 46J as viewed from a viewpoint in the width direction 9. Therefore, there is no fear of application of any large load on the recording paper 14 when the recording paper 14 abuts against the third spur roller 43A. After that, the recording paper 14 is nipped by the second conveyance rollers 42A and the third spur rollers 43A, and the recording paper 14 is conveyed to the downstream in the sheet conveyance direction 6.

The both end portions in the width direction 9 of the recording paper 14 are guided by the second guide surfaces 46P of the first guide member 46 after the portion other than the both end portions is guided by the first guide surface 46J of the first guide member 46. The both end portions in the width direction 9 of the recording paper 14 guided by the second guide surfaces 46P pass over the second conveyance rollers 42A. Subsequently, the both end portions in the width direction 9 of the recording paper 14 abut against the second spur rollers 45A respectively. Accordingly, each of the end portions of the recording paper 14 is successively pushed and moved downwardly as starting from the downstream side portion in the sheet conveyance direction 6 by means of the second spur roller 45A.

In this way, the both end portions in the width direction 9 of the recording paper 14 are guided by the second guide surfaces 46P positioned on the downstream in the sheet conveyance direction 6 as compared with the first guide surface 46J of the first guide member 46. Therefore, the abutment is smoothly caused by the second spur rollers 45A, and the both end portions in the width direction 9 of the recording paper 14 are pushed and moved downwardly. Therefore, even when the recording paper 14 is in the wavy state in the width direction 9 on account of the abutment against the first spur rollers 44A, and the recording paper 14 is in such a state that the both end portions in the width direction 9 leap up in the upward direction, then the recording paper 14 is reliably pushed and moved downwardly by the second spur rollers 45A. After that, the recording paper 14 is discharged onto the paper discharge tray 17 by means of the fourth spur rollers 47A.

Further, when the recording paper 14 is in the inclined state with respect to the conveyance direction, one corner of the recording paper 14 in the width direction 9, which is positioned on the downstream in the conveyance direction, is guided by the third guide surface 46R. Therefore, the recording paper 14 abuts against the second guide surface 46P without receiving any large shock.

Function and Effect of Embodiment

In this embodiment, the recording paper 14 is guided to the third spur rollers 43A of the downstream wavy shape applying mechanism 41 by the first guide surface 461 of the first guide member 46 as the guide member, and the recording paper 14 is allowed to be in the wavy state in the width direction 9 by means of the third spur rollers 43A. In this case, even when the end portion in the width direction 9 of the recording paper 14 is in the leaping up state, there is no fear of abutment of the end portion against the first guide surface 46J. Accordingly, there is no fear of application of any large load on the end portion in the width direction 9 of the recording paper 14. Therefore, it is possible to suppress the occurrence of, for example, the paper clog-up or jam and the damage of the recording paper 14.

Further, the most downstream position of the second guide surface 46P in the conveyance direction 6 is positioned between the third spur roller 43A and the first spur roller 44A. Therefore, the end portion in the width direction 9 of the recording paper 14 is stably conveyed to the first spur roller 44A by means of the second guide surface 46P. Further, the recording paper 14 is nipped or interposed between the second conveyance rollers 42A and the plurality of second spur rollers 45A arranged opposingly to the second conveyance rollers 42A respectively. Therefore, the conveyance of the recording paper 14 is stabilized.

As for the first virtual outer circumferential line VL1 of the first spur roller 44A, the position, at which the distance from the virtual plane VFR is the shortest, is positioned on the downstream in the conveyance direction 6 from the nipping position NP2. Therefore, when the recording paper 14 abuts against the first spur roller 43A, there is no fear of abutment of the recording paper 14 against the second guide surface 46P. It is possible to allow the recording paper 14 to be easily in the state of being depressed in the recessed form.

As for the third virtual outer circumferential line VL3 of the third spur roller 43A, the position, at which the distance from the virtual plane VFR is the shortest, is positioned on the upstream in the conveyance direction 6 from the nipping position NP2 between the second conveyance roller 42A and the second spur roller 45A. Accordingly, it is possible to allow the recording paper 14 to be in the state of being stably depressed in the recessed form.

The first guide member 46 has the third guide surface 46R which is provided at the position corresponding to the second range on the upstream in the conveyance direction 6 from the first spur roller 44A. The third guide surface 46R is inclined with respect to the conveyance direction 6 and the width direction 9. The third guide surface 46R is inclined so that the most downstream position in the conveyance direction 6 is positioned on the both outer sides in the width direction 9 as compared with the most upstream position. Accordingly, the corner of the recording paper 14 is guided by the third guide surface 46R, and the corner of the recording paper 14 abuts against the second guide surface 46P. Therefore, the load applied to the corner can be suppressed as compared with such a case that the abutment is caused directly with respect to the second guide surface 46P.

The first guide member 46 supports the third spur rollers 43A, the first spur rollers 44A, and the second spur rollers 45A. Therefore, the third spur rollers 43A, the first spur rollers 44A, and the second spur rollers 45A can be arranged highly accurately at the predetermined positions respectively.

As for the upstream wavy shape applying mechanism 61 provided on the upstream in the conveyance direction 6 from the recording unit 31, the position, at which the distance from the virtual plane VFR is the shortest in relation to the upstream abutment member 62, is separated by the first distance L1 on the downstream in the conveyance direction 6 from the nipping position NP1 of the conveyance roller pair 21. The position, at which the distance from the virtual plane VFR in relation to the first virtual outer circumferential line VL1 is the shortest, is separated by the second distance L2 on the downstream in the conveyance direction from the nipping position NP2. The second distance L2 is shorter than the first distance L1. Accordingly, the second spur roller 45A abuts against the recording paper 14 before providing the state in which the upstream abutment member 62 does not abut against the recording paper 14. As a result, it is possible to stably maintain the wavy shape of the recording paper 14.

Modified Embodiment

It is also preferable to provide an abutment member capable of pressing the recording paper 14 by making the abutment against the recording paper 14 in place of the second conveyance roller 42A, the third spur roller 43A, the first spur roller 44A, and the second spur roller 45A respectively in the embodiment described above. Alternatively, it is also allowable to adopt such an arrangement that the position, at which the distance from the virtual plane VFR in relation to the first virtual outer circumferential line VL1 of the first spur roller 44A is the shortest, is disposed on the downstream in the conveyance direction from the nipping position NP2 as viewed from a viewpoint in the width direction 9. Further alternatively, it is also allowable to adopt such an arrangement that the position, at which the distance from the virtual plane VFR in relation to the second virtual outer circumferential line VL2 of the second spur roller 45A is the shortest, is disposed on the upstream in the conveyance direction from the nipping position NP2.

Further alternatively, it is also preferable to adopt such an arrangement that the third guide surface 46R is not provided or such an arrangement that the upstream wavy shape applying mechanism 61 is not provided. Further alternatively, it is also allowable to adopt such an arrangement that the third spur roller 43A, the first spur roller 44A, and the second spur roller 45A are supported by any member distinct from the first guide member 46, without being limited to the arrangement in which the third spur roller 43A, the first spur roller 44A, and the second spur roller 45A are supported by the first guide member 46.

What is claimed is:

1. An image recording apparatus comprising:

a recording unit configured to record an image on a sheet conveyed in a conveyance direction;

a first wavy shape applying mechanism provided downstream of the recording unit in the conveyance direction and configured to allow the sheet to be in a wavy state in a width direction orthogonal to the conveyance direction; and a guide member configured to guide the sheet to the first wavy shape applying mechanism, wherein the guide member is provided downstream of the recording unit in the conveyance direction, wherein the first wavy shape applying mechanism includes:

first spur rollers provided within a first range in the width direction to be apart from each other in the width direction and configured to abut against a first surface of the sheet respectively, all of the first spur rollers being provided within the first range and having a first rotation axis which is common to each of the first spur rollers;

abutment members provided between the mutually adjoining first spur rollers respectively and configured to abut against a second surface of the sheet, wherein the abutment members are first conveyance rollers;

second spur rollers provided within second ranges, which are disposed on both outer sides in the width direction of the first range, respectively, having a second rotation axis which is different from the first rotation axis and which is common to the second spur rollers, and configured to abut against the first surface of the sheet downstream of the first spur rollers in the conveyance direction, wherein the first spur rollers and the second spur rollers are provided without making contact with the first conveyance rollers; and third spur rollers arranged opposingly to the first conveyance rollers, having a third rotation axis which is different from the first rotation axis and the second rotation axis and which is common to the third spur rollers, and configured to nip the sheet between the first conveyance rollers and the third spur rollers;

wherein, when viewed in the width direction, each of the third spur rollers partially overlaps with all of the first spur rollers and each of the second spur rollers partially overlaps with all of the first spur rollers;

wherein the guide member includes:

a first guide surface provided at a position upstream of the first spur rollers in the conveyance direction and corresponding to the first range, and being inclined downwardly toward the first spur rollers; and second guide surfaces each provided at a position downstream of the first guide surface and upstream of the second spur rollers in the conveyance direction and corresponding to one of the second ranges, and each being inclined downwardly toward the second spur rollers, and as viewed in the width direction, a portion of the first guide surface and a portion of each of the second guide surfaces are positioned at the same position in the conveyance direction, and the portion of each of the second guide surfaces is positioned above the portion of the first guide surface in a vertical direction orthogonal to the conveyance direction and the width direction.

2. The image recording apparatus according to claim 1, wherein a most downstream position of each of the second guide surfaces in the conveyance direction is positioned between lower ends of the first spur rollers and lower ends of the second spur rollers.

3. The image recording apparatus according to claim 1, wherein as viewed in the width direction, a position, which is on a circular first virtual outer circumferential line along an outer circumference of each of the first spur rollers and at which a distance from a virtual plane is the shortest, is positioned downstream of a first nipping position, at which the sheet is nipped between the first conveyance rollers and the third spur rollers, in the conveyance direction, the virtual plane including an axial center position of the first conveyance rollers and extending along the conveyance direction.

4. The image recording apparatus according to claim 3, wherein as viewed in the width direction, a position, which is on a circular second virtual outer circumferential line along an outer circumference of each of the second spur rollers and at which a distance from the virtual plane is the shortest, is positioned downstream of the first nipping position in the conveyance direction.

5. The image recording apparatus according to claim 1, wherein the guide member further includes third guide surfaces provided at positions corresponding to the second ranges and upstream of the second spur rollers in the conveyance direction, and each of the third guide surfaces is inclined, with respect to the conveyance direction and the width direction, so that a most downstream portion in the conveyance direction thereof is positioned on an outer side in the width direction as compared with a most upstream portion in the conveyance direction thereof.

6. The image recording apparatus according to claim 1, wherein the guide member is configured to support the first spur rollers, the second spur rollers, and the third spur rollers.

7. The image recording apparatus according to claim 3, further comprising a second wavy shape applying mechanism provided upstream of the recording unit in the conveyance direction and configured to allow the sheet to be in the wavy state, wherein the second wavy shape applying mechanism includes:

a second conveyance roller pair configured to convey the sheet to the recording unit while nipping the sheet therebetween; and second abutment members provided between the recording unit and a second nipping position at which the sheet is nipped by the second conveyance roller pair in the conveyance direction, arranged in the width direction with spacing apart from each other, and configured to abut against the first surface of the sheet respectively, a position, which is included in the second abutment member and at which a distance from the virtual plane is the shortest, is separated by a third distance downstream in the conveyance direction from the second nipping position, a position, which is on a circular second virtual outer circumferential line along an outer circumference of each of the second spur rollers and at which a distance from the virtual plane is the shortest, is separated by a fourth distance downstream in the conveyance direction from the first nipping position; and the fourth distance is shorter than the third distance.

8. An image recording apparatus comprising:

a recording unit configured to record an image on a sheet conveyed in a conveyance direction;

a wavy shape applying mechanism configured to allow the sheet conveyed in the conveyance direction to be in a wavy state in a width direction orthogonal to the conveyance direction; and a guide member configured to guide the sheet to the wavy shape applying mechanism, wherein the wavy shape applying mechanism includes:

first abutment members provided within a range in the width direction to be apart from each other in the width direction and configured to abut against a first surface of the sheet respectively, all of the first abutment members being provided within the range;

second abutment members configured to abut against a second surface of the sheet between the mutually adjoining first abutment members respectively; and third abutment members provided at positions corresponding to both outer sides of the range in the width direction respectively and configured to abut against the first surface of the sheet downstream of the first abutment members in the conveyance direction, the guide member includes:

a first guide surface provided at a position upstream of a position at which the first abutment members abut against the sheet in the conveyance direction and corresponding to the range, and being inclined so that a distance from the second abutment members, which is provided in an orthogonal direction orthogonal to the conveyance direction and the width direction, is shortened from upstream to downstream in the conveyance direction; and a second guide surface provided upstream of the second abutment members in the conveyance direction and being inclined so that a distance from the second abutment members in the orthogonal direction is shortened from upstream to downstream in the conveyance direction.

9. The image recording apparatus according to claim 1, wherein when viewed in the width direction, each of the first spur rollers overlaps with respective nip points between the third spur rollers and the first conveyance rollers.

10. The image recording apparatus according to claim 1, wherein when viewed in the width direction, each of the first spur rollers partially overlaps with all of the first conveyance rollers.

* * * * *